US011535905B2

(12) United States Patent
Kolbe et al.

(10) Patent No.: US 11,535,905 B2
(45) Date of Patent: Dec. 27, 2022

(54) USE OF A Q AND P STEEL FOR PRODUCING A SHAPED COMPONENT FOR HIGH-WEAR APPLICATIONS

(71) Applicants: ThyssenKrupp Steel Europe AG, Duisburg (DE); thyssenkrupp AG, Essen (DE)

(72) Inventors: Nina Kolbe, Bochum (DE); Patrick Kuhn, Kamen (DE); Clemens Latuske, Dusseldorf (DE); Richard Georg Thiessen, JK Malden (NL)

(73) Assignee: thyssenkrupp AG, Essen (DE)

( * ) Notice: Subject to any disclaimer, the term of this patent is extended or adjusted under 35 U.S.C. 154(b) by 296 days.

(21) Appl. No.: 16/640,147

(22) PCT Filed: Aug. 22, 2017

(86) PCT No.: PCT/EP2017/071147
§ 371 (c)(1),
(2) Date: Feb. 19, 2020

(87) PCT Pub. No.: WO2019/037838
PCT Pub. Date: Feb. 28, 2019

(65) Prior Publication Data

US 2020/0291495 A1 Sep. 17, 2020

(51) Int. Cl.
*C21D 1/18* (2006.01)
*C22C 38/00* (2006.01)
(Continued)

(52) U.S. Cl.
CPC ..... *C21D 1/18* (2013.01); *C22C 38/001* (2013.01); *C22C 38/02* (2013.01); *C22C 38/04* (2013.01);
(Continued)

(58) Field of Classification Search
CPC ..... C21D 1/18; C21D 2211/001; C21D 2211/002; C21D 2211/005;
(Continued)

(56) References Cited

U.S. PATENT DOCUMENTS 3,619,247 A 11/1971 Newport et al.
3,681,118 A 8/1972 Ohama et al.
(Continued)

FOREIGN PATENT DOCUMENTS

CN 102925799 A 2/2013
CN 103215516 A 7/2013
(Continued)

OTHER PUBLICATIONS

Cunyu Wang, Xiaodong Li, Ying Chang, Shuo Han, Han Dong, Comparison of three-body impact abrasive wear behaviors for quenching-partitioning-tempering and quenching-tempering 20Si2Ni3 steels, 2016, Elsevier, Wear 362-363 (Year: 2016).*
(Continued)

*Primary Examiner* — Nicholas A Wang
*Assistant Examiner* — Maxwell Xavier Duffy
(74) *Attorney, Agent, or Firm* — RMCK Law Group PLC

(57) ABSTRACT

The invention relates to the use of a Q&P steel for production of a formed component (2) for high-wear applications, wherein the Q&P steel has a hardness of at least 230 HB, especially at least 300 HB, preferably at least 370 HB, and a bending angle α of at least 60°, especially at least 75°, preferably at least 85°, determined to VDA238-100, and/or a bending ratio of r/t<2.5, especially r/t<2.0, preferably r/t<1.5, where t corresponds to the material thickness of the steel and r to the (inner) bending radius of the steel.

11 Claims, 1 Drawing Sheet

(51) Int. Cl.

| | |
|---|---|
| ***C22C 38/02*** | (2006.01) |
| ***C22C 38/04*** | (2006.01) |
| ***C22C 38/06*** | (2006.01) |
| ***C23C 28/00*** | (2006.01) |
| ***C23G 1/00*** | (2006.01) |
| ***C25D 3/22*** | (2006.01) |

(52) U.S. Cl.
CPC ..... *C22C 38/06* (2013.01); *C23C 28/00* (2013.01); *C23G 1/00* (2013.01); *C25D 3/22* (2013.01); *C21D 2211/001* (2013.01); *C21D 2211/002* (2013.01); *C21D 2211/003* (2013.01); *C21D 2211/005* (2013.01); *C21D 2211/008* (2013.01)

(58) Field of Classification Search
CPC ... C21D 2211/008; C22C 38/02; C22C 38/04; C22C 38/38; C22C 38/58; C23C 28/00; C23G 1/00
See application file for complete search history.

(56) References Cited

U.S. PATENT DOCUMENTS

| | | | | |
|---|---|---|---|---|
| 5,518,772 | A | 5/1996 | Andachi et al. | |
| 9,695,487 | B2 | 7/2017 | Zhang et al. | |
| 10,550,447 | B2 | 2/2020 | Drillet et al. | |
| 2009/0297881 | A1 | 12/2009 | Maalman et al. | |
| 2012/0107636 | A1 | 5/2012 | Diez et al. | |
| 2014/0127074 | A1 | 5/2014 | Rosteck et al. | |
| 2014/0322559 | A1* | 10/2014 | Becker ..... | C21D 6/002 148/333 |
| 2015/0010779 | A1 | 1/2015 | Szesni et al. | |
| 2015/0209848 | A1 | 7/2015 | Kopplin et al. | |
| 2015/0292072 | A1 | 10/2015 | Mataigne et al. | |
| 2015/0344996 | A1 | 12/2015 | Kawano et al. | |
| 2016/0002763 | A1 | 1/2016 | Diez et al. | |
| 2016/0017449 | A1 | 1/2016 | Wang et al. | |

FOREIGN PATENT DOCUMENTS

| | | | |
|---|---|---|---|
| CN | 104011230 | A | 8/2014 |
| CN | 105568141 | A | 5/2016 |
| DE | 152143 | A1 | 11/1981 |
| DE | 69329831 | | 4/2001 |
| DE | 102010050499 | | 1/2012 |
| DE | 202005022081 | U1 | 3/2013 |
| DE | 102012017703 | A1 | 3/2014 |
| DE | 202014008863 | U1 | 12/2014 |
| DE | 112014000102 | | 3/2015 |
| DE | 202014010854 | U1 | 12/2016 |
| EP | 2559782 | A1 | 2/2013 |
| EP | 2837707 | A1 | 2/2015 |
| EP | 2930253 | A1 | 10/2015 |
| EP | 2430207 | B1 | 1/2017 |
| EP | 2837707 | B1 | 6/2018 |
| JP | 2002020854 | A | 1/2002 |
| RU | 2395593 | C1 | 7/2010 |
| RU | 2593566 | C2 | 8/2016 |
| WO | 2006002843 | A1 | 1/2006 |
| WO | 2012120020 | A1 | 9/2012 |

OTHER PUBLICATIONS

F.B. Fletcher, Carbon and Low-Alloy Steel Plate, 1990, ASM Handbook, vol. 1, pp. 226-239 (Year: 1990).*

Friction wheel test ASTM G65-04 (2010) (dry sand/rubber wheel test).

International Search Report and Written Opinion for International Application No. PCT/EP2017/071147 dated May 11, 2018.

Liu, et al., "Application of quenching-partitioning-tempering process and modification to a newly designed ultrahigh carbon steel", Elsevier, 2013.

Russian Office Action for RU Application No. 2020111323/05 dated Dec. 1, 2020.

Wang, et al., "Comparison of three-body impact abrasive wear behaviors for quenching-partitioning-tempering and quenching-tempering 20Si2Ni3 steels", Elsevier, 2016.

Metallic materials—Sheet and strip—Hold expanding test, ISO 16630, Sep. 2017.

Metallic materials—Tensile testing—Part 1: Method of test at room tempertature (ISO 6892-1, 2016).

Chinese Office Action and Search Report for CN Application No. 201780094130.8 dated Feb. 29, 2021.

International Search Report for International Application No. PCT/EP2018/074928 dated Dec. 19, 2018.

* cited by examiner

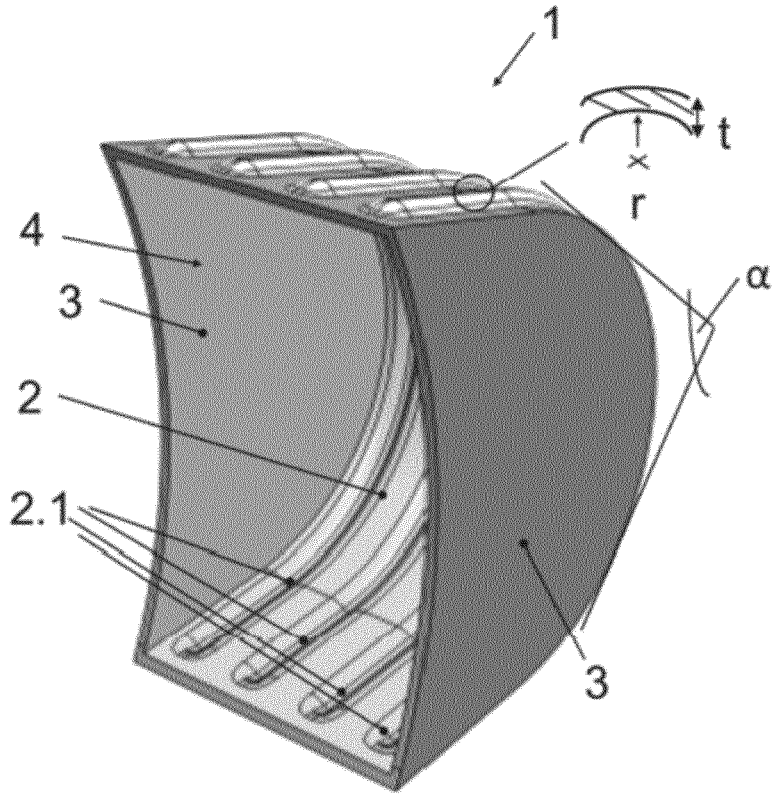
1
t
r
4
3
2
2.1
α
3

USE OF A Q AND P STEEL FOR PRODUCING A SHAPED COMPONENT FOR HIGH-WEAR APPLICATIONS

CROSS-REFERENCE TO RELATED APPLICATIONS

This application is a 371 U.S. National Stage of International Application No. PCT/EP2017/071147, filed Aug. 22, 2017. The disclosure of the above application is incorporated herein by reference in its entirety.

TECHNICAL FIELD

The invention relates to the use of a Q&P steel for production of a formed component for high-wear applications.

TECHNICAL BACKGROUND

The wear-resistant steels known from the art are extremely hard in view of their end use and correspondingly have high strength in conjunction with limited ductility. The aim of a high hardness required in a wear-resistant steel is sufficiently high resistance to abrasive wear.

Conventional wear-resistant steels having high hardness are generally only of limited formability and have, for example, a minimum bending ratio of about r/t=2.5 at a hardness of 400 HB, where r corresponds to the inner radius of the bent portion in the bending of the steel and t to the material thickness of the steel/portion. With increasing hardness, there is a decrease in the bending capacity of the steel and a bending ratio r/t<2.5 is possible only with a high level of complexity, if at all, which means that the further processing of the steel, especially to give components (component parts) of complex shape is impaired or limited to a high degree. It cannot be ruled out that, in the forming/reforming of the wear-resistant steel, depending on the geometry or complexity to be produced, or in the event of further stress in the use of the steel, microcracks/cracks or small cracks will arise in the surface or in the near-surface region of the wear-resistant steel, which can even lead to complete component failure owing to the low ductility.

Complex, formed components for high-wear applications are not producible from one part with conventional wear-resistant steels owing to their high hardness and limited ductility, and so, in the case of corresponding applications, it is necessary to resort to welded constructions formed from multiple different components or component parts. Especially in the case of production of excavator shovels, such constructions are comparatively heavy and hence the loading volume must be reduced since, for example, the jib of an excavator must not exceed a maximum weight. The welding of conventional wear-resistant steels additionally constitutes a high demand on the execution of the weld bond, and some conventional wear-resistant steels are weldable only with a high level of complexity depending on the alloy elements and contents. In the region of the weld bond, owing to the heating during welding, a zone of a few millimeters in width (zone of thermal influence, WEZ) with reduced hardness and relatively low wear resistance is formed, which is locally prone to failure as a result of stress by comparison with the remainder of the construction.

Q&P steels, "Quenching and Partitioning" steels, and manufacture for adjustment of their mechanical properties are known from the prior art. These steels that were specially developed for the automobile industry combine high strengths with simultaneously high elongation and are of particularly good suitability as components, particularly for use in crash-relevant regions, since, in the event of an impact/crash, by virtue of their mechanical properties, they are able to optimally dissipate the impact energy by deformation. By way of example, European published specifications EP 2 837 707 A1, EP 2 559 782 A1 and EP 2 930 253 A1 are cited. There is no pointer to provide such steels for high-wear applications in these documents.

SUMMARY OF THE INVENTION

It is an object of the present invention to provide a Q&P steel with which components having complex geometry can be produced for high-wear applications.

This object is achieved by the features of claim 1.

The inventors have found that, surprisingly, it is possible by the manufacture of the Q&P steels to specifically establish predominantly a proportion of martensite of at least 70 area %, especially of at least 80 area %, preferably of at least 85 area %, in the microstructure, where at least half is annealed martensite, and the remaining balance may consist of one or more proportions of up to 30 area % of ferrite, of up to 30 area % of residual austenite, of up to 30 area % of bainite, of up to 5 area % of cementite, it being possible, according to the alloy elements and microstructure of the Q&P steels, to achieve hardnesses that can be at a level of comparable wear-resistant steels but have a higher forming capacity compared to the wear-resistant steels by virtue of the softer components in the microstructure compared to martensite, it is possible to produce a formed component, especially with complex geometry with excellent wear-resistant properties. The formed component can be produced by bending, edging, deep drawing, etc. The Q&P steel has a hardness of at least 230 HB, especially at least 300 HB, preferably at least 370 HB, more preferably at least 400 HB, further preferably at least 425 HB, especially preferably at least 450 HB. HB corresponds to the Brinell hardness and is determined according to DIN EN ISO 6506-1. Studies have shown that a Q&P steel or a component produced from a Q&P steel, by comparison with a conventional wear-resistant steel or a component of the same hardness class produced from a conventional wear-resistant steel, has comparable abrasion, while, by virtue of the higher forming capacity, a bending angle $\alpha$ of at least 60°, especially at least 75°, preferably at least 85°, more preferably at least 90°, especially preferably at least 95°, determined according to VDA238-100, and/or a bending ratio of r/t<2.5, especially r/t<2.0, preferably r/t<1.5, more preferably r/t<1.0, where t corresponds the material thickness of the steel and r to the (inner) bending radius of the steel, is possible.

The manufacture of the Q&P steels and the establishment of mechanical properties, especially of the aforementioned microstructure, are known in the specialist field. In a first configuration, the Q&P steel or the component produced from the Q&P steel consists of, aside from Fe and unavoidable impurities from the production, in % by weight:

C: 0.1-0.3%,
Si: 0.5-1.8%,
Mn: 1.5-3.0%,
Al: up to 1.5%,
N: up to 0.008%,
P: up to 0.02%,
S: up to 0.003%,
optionally of one or more elements from the group of "Cr, Mo, Ni, Nb, Ti, V, B" with
Cr: up to 0.4%, Mo: up to 0.25%,
Ni: up to 1.0%
Nb: up to 0.06%,
Ti: up to 0.07%,
V: up to 0.3%,
B: up to 0.002%.

The Q&P steel is preferably a hot strip having a tensile strength ($R_m$) between 800 and 1500 MPa, a yield point ($R_e$) above 700 MPa, an elongation at break ($A_{50}$) between 7% and 25% to DIN EN ISO 6892, and very good deformability, for example a hole expansion of >20% to DIN ISO 16630.

Carbon (C) has several important functions in the Q&P steel. The C content primarily plays a crucial role in austenite formation during production, which is crucial particularly for the martensite in the end product. The strength of the martensite likewise depends strongly on the C content of the composition of the steel. In addition, the C content, by comparison with other alloy elements, makes the highest contribution to a higher CE value (CE=carbon equivalent), with an adverse effect on weldability. With the C content used, it is possible to specifically influence the strength level of the end product. Therefore, the C content is limited to between 0.1% and 0.3% in total.

Manganese (Mn) is an important element in respect of the hardenability of the Q&P steel. At the same time, Mn reduces the tendency to unwanted formation of pearlite during cooling. These properties enable the establishment of a suitable starting microstructure composed of martensite and residual austenite after the first quench (quench step) at cooling rates of <100 K/s. By contrast, too high an Mn content has an adverse effect on elongation and weldability, i.e. the CE value. Therefore, the Mn content is limited to between 1.5% and 3.0% by weight. To establish the desired strength properties, preference is given to using 1.9% to 2.7% by weight.

Silicon (Si) has a crucial share in the suppression of pearlite control and control of carbide formation. The formation of cementite binds carbon, and hence it is no longer available for further stabilization of the residual austenite. On the other hand, too high an Si content worsens elongation at break and surface quality through accelerated formation of red scale. A similar effect can also be achieved by the inclusion of Al in the alloy (>=0.5% by weight), such that, in combination with Al>=0.5% by weight, an Si content between 0.5% and 1.1% by weight is established. For the establishment of the features described above, a minimum of 0.7% by weight is required; preference is given to including contents over and above 1.0% by weight for reliable establishment of the desired microstructure. The upper limit is limited to a maximum of 1.8% by weight owing to the desired elongation at break, preferably to a maximum of 1.6% by weight for achievement of the desired surface quality.

Aluminum (Al) is used for deoxidation and for binding of any nitrogen present. Furthermore, Al can also, as already described, be used for suppression of cementite, but is not as effective as Si. At the same time, elevated addition of Al distinctly increases the austenitization temperature, for which reason cementite suppression is preferably implemented by Si only. To limit the austenitization temperature, an Al content of 0% to 0.003% by weight is established if sufficient Si is used for suppression of cementite. If, by contrast, the Si content, for example for reasons of the desired surface quality, is further limited, Al is included in the alloy with a minimum content of 0.5% by weight for cementite suppression. The maximum Al content of 1.5% by weight, preferably 1.3% by weight, results from the avoidance of casting-related problems.

Phosphorus (P) has an unfavorable effect on weldability and should therefore be limited to a maximum of 0.02% by weight.

Sulfur (S) in sufficiently high concentration leads to formation of MnS or (Mn, Fe)S, which has an adverse effect on elongation. Therefore, the S content is limited to a maximum of 0.003% by weight.

Nitrogen (N) leads to formation of nitrides, which have an adverse effect on formability. Therefore, the N content is limited to a maximum of 0.008% by weight.

Chromium (Cr) is an effective inhibitor of pearlite and can thus lower the required minimum cooling rate, for which reason it is optionally included in the alloy. For effective adjustment of this effect, a minimum proportion of 0.1% by weight, preferably 0.15% by weight, is envisaged. At the same time, strength is significantly increased by the addition of Cr, and there is additionally the risk of marked grain boundary oxidation. Furthermore, high Cr contents have an adverse effect on forming properties and on long-term strength under cyclical stress, which play a crucial role particularly in the case of wear-resistant, complex-shaped and cyclically stressed components. Therefore, the Cr content is limited to a maximum of 0.4% by weight, preferably 0.35% by weight, more preferably 0.3% by weight.

Molybdenum (Mo) is likewise a very effective element for suppression of pearlite formation. In the case of correspondingly defined analysis compositions, for reliable avoidance of pearlite, a minimum content of 0.05% by weight, preferably 0.1% by weight, is required. For reasons of cost, limitation to a maximum of 0.25% by weight is advisable.

Nickel (Ni), just like Cr, is an inhibitor of pearlite, but is not as effective. In the case of inclusion of Ni in the alloy, the corresponding minimum content is thus much higher than that of Cr and can therefore be 0.25% by weight, preferably 0.3% by weight. At the same time, Ni is a very costly alloy element and the addition of Ni significantly increases strength. Therefore, the Ni content is limited to a maximum of 1.0% by weight, preferably 0.5% by weight.

It is also possible to include microalloy elements (MLE) in the alloy, such as V, Ti or Nb, in the Q&P steel described here. These elements, through the formation of very finely distributed carbides (or carbonitrides in the case of simultaneous presence of N), can contribute to a higher strength. However, the mode of action of these three elements is very different. A minimal MLE content leads to freezing of the grain and phase boundaries after the hot rolling process during the partitioning step, which promotes the desired combination of properties of strength and formability by grain refining. The minimal MLE content for Ti is 0.02% by weight, that for Nb is 0.01% by weight, and that for V is 0.1% by weight. Too high a concentration of the MLEs leads to formation of carbides and hence to binding of carbon that is then no longer available for the stabilization of the residual austenite. In accordance with the mode of action of the individual elements, therefore, the upper limit for Ti is fixed at 0.07% by weight, that for Nb at 0.06% by weight, and that for V at 0.3% by weight.

Boron (B) is segregated at the phase boundaries and prevents their movement. This leads to a finer-grain microstructure, which can have an advantageous effect on the mechanical properties. Therefore, when this alloy element is used, a minimum content of 0.0008% by weight should be observed. When B is included in the alloy, however, sufficient Ti for the binding of the N must be present. For complete binding of N, the Ti content should be provided at at least 3.42*N. The effect of B is saturated in the case of a content of around 0.002% by weight, which thus corresponds to the upper limit.

The microstructure in the end product can be determined, for example, by means of scanning electron microscopy (SEM) and at least 5000-fold magnification. The quantitative determination of the residual austenite can be effected, for example, by means of x-ray diffraction (XRD) to ASTM E975.

A particular crucial factor for the mechanical properties of the end product, aside from the pure phase contents, is the distortion of the crystal lattice. This lattice distortion is a measure of the initial resistance to plastic deformation, which is property-determining owing to the desired strength ranges. A suitable method for the measurement and hence quantification of lattice distortion is Electron Backscatter Diffraction (EBSD). EBSD generates and combines many very local diffraction measurements in order to determine small differences and profiles and local misorientations in the microstructure. An EBSD analysis method using common practice is called Kernel Average Misorientation (KAM; further description in the handbook "OIM Analysis v5.31" from EDAX Inc., 91 McKee Drive, Mahwah, N.J. 07430, USA), in which the orientation of a measurement point is compared with the orientation of the neighboring points. Below a threshold value, typically of 5°, adjacent points are assigned to the same (distorted) grain. Above this threshold value, the adjacent points are assigned to different (sub)grains. Owing to the very fine microstructure, a maximum step width of 100 nm is chosen for the EBSD analysis method. For assessment of the Q&P steels, the KAM is evaluated in each case in relation to the current measurement point and its third-closest neighboring point. The Q&P steel has a microstructure composed of annealed and non-annealed martensite with proportions of residual austenite. Bainite is preferably present only in a small proportion in the microstructure. The desired microstructure is characterized by a defined local misorientation in the iron lattice. This is quantified by the KAM. The end product may have a KAM average for a measurement range of at least 75 μm×75 μm of >1.20°, preferably >1.25°.

In one configuration, the Q&P steel or the component produced from the Q&P steel may have been pickled and/or coated on one or both sides with an anticorrosion coating and/or coated on one or both sides with an organic coating. Preferably, the Q&P steel or the component produced from the Q&P steel has been provided on one or both sides with an anticorrosion coating, especially based on zinc. Particular preference is given to an electrolytic zinc coating on one or both sides. The performing of an electrolytic coating has the advantage that the properties of the Q&P steel are not adversely altered particularly by thermal effects as would occur, for example, in the performance of a hot dip coating operation. Alternatively or additionally, the Q&P steel or the component produced from the Q&P steel may have been provided on one or both sides with an organic coating, preferably with a lacquer. In this way, Q&P steels or the components produced from the Q&P steel may be provided for high-wear applications with an improved painted look.

In a further configuration, the Q&P steel or the component produced from the Q&P steel has a material thickness between 1.5 and 15 mm, especially a thickness between 2.5 and 10 mm, preferably between 3.5 and 8 mm.

In a further configuration, the Q&P steel is used to produce a component which is used in construction machinery, agricultural machinery, mining machinery, transport machinery or conveyor systems. Preferably, the component produced is a grab, especially for a scrap grab or part thereof, or a shovel, especially for an excavator or part thereof, especially for earthmoving, or part of a conveying apparatus, especially for conveying abrasive suspensions or solid substances.

BRIEF DESCRIPTION OF THE DRAWING

There follows an elucidation of the invention in detail with reference to a drawing that shows a working example. The drawing shows:

FIG. 1) a perspective view of an excavator shovel.

DESCRIPTION OF THE PREFERRED EMBODIMENTS

The sole FIGURE shows an excavator shovel (1) in a perspective view. The excavator shovel (1) is a welded construction assembled, for example, from three components (2, 3), from a complex-shaped half-shell (2) and two side components (3) cohesively bonded to the half-shell (2) for producing a cavity (4) which is open to one side and serves to accommodate material to be cleared (not shown). Over part of the circumference of the semifinished product (2), four embossments (2.1) running parallel to one another, especially for reinforcing the excavator shovel (1), have been molded. The molding of the embossments (2.1) allows the material thickness (t) of the half-shell (2) to be reduced compared to a half-shell without embossments for the same performance, such that the total weight of the excavator shovel (1) can be reduced and the loading volume at a maximum permissible load of the jib of an excavator can be increased.

The component or half-shell (2) consists of a Q&P steel consisting of, aside from Fe and unavoidable impurities from the production, in % by weight:

C: 0.1-0.3%,
Si: 0.5-1.8%, preferably Si: 1.0-1.6%,
Mn: 1.5-3.0%, preferably Mn: 1.9-2.7%,
Al: up to 1.5%,
N: up to 0.008%,
P: up to 0.02%,
S: up to 0.003%,
optionally with one or more elements from the group of "Cr, Mo, Ni, Nb, Ti, V, B" with
Cr: up to 0.4%, preferably Cr: 0.15-0.35%,
Mo: up to 0.25%, especially Mo: 0.05-0.25%,
Ni: up to 1.0%, especially Ni: 0.25-1.0%,
Nb: up to 0.06%, especially Nb: 0.01-0.06%,
Ti: up to 0.07%, especially Ti: 0.02-0.07%,
V: up to 0.3%, especially V: 0.1-0.3%,
B: up to 0.002%, especially B: 0.0008-0.002%.

For production of a Q&P steel, a steel alloy with the aforementioned composition is melted and cast to a slab or thin slab. The slab or thin slab is heated through at a temperature between 1000 and 1300° C., and hot rolled to give a hot strip with a material thickness between 1.5 and 15 mm, with the hot rolling ending at a hot rolling end temperature of > $A_{c3}$−100° C. (Acs depending on the steel composition), followed by quenching (quench step) of the hot strip from the hot rolling end temperature at a cooling rate between 30 and 100 K/s to a quench temperature, with RT<quench temperature <$M_S$+100° C., where RT corresponds to room temperature and $M_S$ is dependent on the steel composition and can be ascertained as follows: $M_S$ [° C.]=462-273% C-26% Mn-13% Cr-16% Ni-30% Mo. The hot strip quenched to quench temperature can optionally be wound. Subsequently, the hot strip is kept at a temperature of −80° C.<quench temperature<+80° C. for a duration between 6 and 2880 min. The hot strip is heated to a partitioning temperature or kept at a partitioning temperature which is at least the quench temperature+/−80° C. of the hot strip and at most 500° C., for a partitioning time between 30 and 1800 min. In the case that heating to the partitioning temperature takes place, the heating rate is not more than 1 K/s. Subsequently, the hot strip is cooled down to RT.

The correspondingly produced hot strip made from Q&P steel preferably has a tensile strength ($R_m$) between 800 and 1500 MPa, a yield point ($R_e$) above 700 MPa, an elongation at break ($A_{50}$) between 7% and 25% to DIN EN ISO 6892, and very good deformability, for example hole expansion>20% to DIN ISO 16630. The hot strip preferably has a microstructure with a martensite content of >85 area %, preferably >90 area %, of which >50% is annealed martensite. The residual austenite content is <15 area %; the proportions of bainite, polygonal ferrite and cementite are each less than 5 area %, where one or more of the proportions of bainite, polygonal ferrite and cementite are absent. In addition, the hot strip may be pickled and/or coated with an especially inorganic anticorrosion coating and/or an organic coating. Semifinished products are divided from the hot strip produced and provided for production of components for high-wear applications. The Q&P steels are suitable for the production of components, especially having complex geometry, for example for geometries having a bending angle α of at least 60°, especially at least 75°, preferably at least 85°, more preferably at least 90°, especially preferably at least 95°, for example the degree of forming of the half-shell (2), and/or having a bending ratio of r/t<2.5, especially r/t<2.0, preferably r/t<1.5, where t corresponds to the material thickness of the steel and r to the (inner) bending radius of the steel, for example in the region of the embossments (2.1); see FIG. 1. The side components (3), if they do not have to be subjected to complex shaping, may be provided from conventional wear-resistant steels.

The invention is not limited to the working example shown in the drawing and to the embodiments in the general description. Instead, it is also possible to produce other components for any high-wear applications, especially those having a complex geometry, from a Q&P steel, which have especially been cold-formed, especially components or parts for construction machinery, agricultural machinery, mining machinery, transport machinery or conveying systems.

The invention claimed is:

1. A formed component for high-wear applications, the formed component produced by a Q&P steel wherein the Q&P steel has a hardness of at least 370 HB, and at least one of a bending angle α of at least 85°, determined to VDA238-100, and a bending ratio of r/t<1.5, where t corresponds to a material thickness of the steel and r to an inner bending radius of the steel, wherein the component has a material thickness (t) between 1.5 and 15 mm, has a Kernel Average Misorientation (KAM) average of >1.20° and comprises Fe and a remainder including unavoidable impurities from a preparation of, in % by weight:

C: 0.1-0.3%;
Si: 0.7-1.8%;
Mn: 1.5-3.0%;
Al: up to 1.5%;
N: up to 0.008%;
P: up to 0.02%; and
S: up to 0.003%.

2. The component of claim 1, wherein the component has been one of pickled and coated on at least one side with one of an anticorrosion coating and an organic coating.

3. The component of claim 1 wherein the component produced is used in construction machinery, agricultural machinery, mining machinery, transport machinery or conveying systems.

4. The component of claim 1, wherein the component produced is a grab.

5. The formed component of claim 1 wherein the component further comprises:

at least one of "Cr, Mo, Ni, Nb, Ti, V, B" with
Cr: up to 0.4%,
Mo: up to 0.25%,
Ni: up to 1.0%
Nb: up to 0.06%,
Ti: up to 0.07%,
V: up to 0.3%,
B: up to 0.002%.

6. The component of claim 1 wherein the material thickness (t) is between 2.5 and 10 mm.

7. The component of claim 1 wherein the material thickness (t) is between 3.5 and 8 mm.

8. The component of claim 1 wherein the component produced is one of a scrap grab or part thereof.

9. The component of claim 1 wherein the component produced is a shovel.

10. The component of claim 1 wherein the component produced is part of a conveying device.

11. The component of claim 1 wherein the component produced is a part for conveying one of abrasive suspensions and solid substances.

* * * * *